US006568723B2

(12) United States Patent
Murphy et al.

(10) Patent No.: US 6,568,723 B2
(45) Date of Patent: May 27, 2003

(54) SASH LOCK FOR A SASH WINDOW

(75) Inventors: Mark V. Murphy, Oak Park, IL (US); Dean Pettit, St. John, IN (US)

(73) Assignee: Ashland Paroducts, Inc., Lowell, IN (US)

( * ) Notice: Subject to any disclaimer, the term of this patent is extended or adjusted under 35 U.S.C. 154(b) by 0 days.

(21) Appl. No.: 09/961,501

(22) Filed: Sep. 24, 2001

(65) Prior Publication Data

US 2003/0057717 A1 Mar. 27, 2003

(51) Int. Cl.[7] ..... E05C 3/04

(52) U.S. Cl. ..... 292/241; 292/DIG. 7; 292/DIG. 38; 292/DIG. 47

(58) Field of Search ..... 292/240, 241, 292/DIG. 7, DIG. 47, DIG. 38

(56) References Cited

U.S. PATENT DOCUMENTS

| | | | | |
|---|---|---|---|---|
| 201,146 | A | | 3/1878 | Adler |
| 336,302 | A | | 2/1886 | Dudgeon |
| 480,148 | A | | 8/1892 | Theby |
| 878,206 | A | | 2/1908 | Johnson |
| 1,041,803 | A | | 10/1912 | Kilburn |
| 1,059,999 | A | | 4/1913 | James et al. |
| 1,253,810 | A | | 1/1918 | Gianninoto |
| 1,393,628 | A | | 10/1921 | Leichter |
| 1,550,532 | A | | 8/1925 | French |
| 1,704,946 | A | | 3/1929 | Lindgren |
| 1,901,974 | A | | 3/1933 | Macy |
| 2,537,736 | A | | 1/1951 | Carlson |
| 3,027,188 | A | | 3/1962 | Eichstadt |
| 3,438,153 | A | | 4/1969 | Lemme |
| 3,645,573 | A | * | 2/1972 | Strang ..... 292/241 |
| 3,655,230 | A | * | 4/1972 | Armstrong ..... 292/169 |
| 3,811,718 | A | * | 5/1974 | Bates ..... 292/241 |
| 4,227,345 | A | | 10/1980 | Durham, Jr. |
| 4,305,612 | A | | 12/1981 | Hunt et al. |
| 4,558,174 | A | * | 12/1985 | Massey ..... 174/92 |
| 4,736,972 | A | * | 4/1988 | Mosch ..... 292/204 |

(List continued on next page.)

FOREIGN PATENT DOCUMENTS

| | | |
|---|---|---|
| GB | 341207 | 1/1931 |
| GB | 2026594 | 2/1980 |

OTHER PUBLICATIONS

Page 21, Home Protection Hardware Catalog Price List, dated Jul. 1986.

*Primary Examiner*—Gary Estremsky
(74) *Attorney, Agent, or Firm*—Wallenstein & Wagner, Ltd.

(57) ABSTRACT

A sash lock for a sash window assembly is disclosed. The sash window assembly includes an upper sash window and a lower sash window. Each of the sash windows is mounted within opposed guide rails on a master frame. At least one of the sash windows is slidable within the frame relative to the other sash window. The sash lock comprises a keeper for mounting on a style of one of the sash windows. The keeper includes a keeper surface. The sash lock also includes a locking assembly for mounting on an adjacent style of the other of the sash windows. The locking assembly includes a housing having a hole, an actuator arm, and a cam having a cam surface for engaging the keeper surface. The locking assembly also includes a shaft extending through the housing hole and operably coupling the actuator arm to the cam. The keeper, the housing, the actuator arm and the shaft are formed of plastic and the cam is formed of metal.

12 Claims, 4 Drawing Sheets

U.S. PATENT DOCUMENTS 4,801,164 A * 1/1989 Mosch ..... 292/204
4,961,286 A 10/1990 Bezubic
5,042,855 A * 8/1991 Bennett ..... 292/241
5,072,464 A 12/1991 Draheim et al.
5,076,015 A 12/1991 Manzalini
5,087,088 A 2/1992 Milam
5,090,750 A 2/1992 Lindqvist
5,127,685 A 7/1992 Dallaire et al.
5,139,291 A 8/1992 Schultz
5,161,839 A * 11/1992 Piltingsrud ..... 292/241
5,398,447 A 3/1995 Morse
5,582,445 A 12/1996 Olsen et al.
RE35,463 E 2/1997 Vetter et al.
5,741,032 A * 4/1998 Chaput ..... 292/202
5,992,907 A 11/1999 Sheldon et al.
6,116,665 A 9/2000 Subliskey
6,142,541 A 11/2000 Rotondi

* cited by examiner

SASH LOCK FOR A SASH WINDOW

CROSS-REFERENCE TO RELATED APPLICATIONS

Not Applicable.

FEDERALLY SPONSORED RESEARCH OR DEVELOPMENT

Not Applicable.

TECHNICAL FIELD

The present invention relates to a sash lock for a sash window.

BACKGROUND OF THE INVENTION

Prior art to this invention includes U.S. Pat. Nos. 5,582,445; 5,741,032; 6,116,665; 6,142,541; and Re. 35,463. However, none of these patents discloses a sash lock having a cam formed of a metal, such as zinc, and all other components formed of a plastic.

The present invention is provided to solve these and other problems.

SUMMARY OF THE INVENTION

It is an object of the invention to provide a sash lock for a sash window assembly.

In accordance with the invention, the sash window assembly includes an upper sash window and a lower sash window. Each of the sash windows is mounted within opposed guide rails on a master frame. At least one of the sash windows is slidable within the frame relative to the other sash window.

The sash lock comprises a keeper for mounting on a style of one of the sash windows. The keeper includes a keeper surface. The sash lock also includes a locking assembly for mounting on an adjacent style of the other of the sash windows. The locking assembly includes a housing having a hole, an actuator arm, and a cam having a cam surface for engaging the keeper surface. The locking assembly also includes a shaft extending through the housing hole and operably coupling the actuator arm to the cam. The keeper, the housing, the actuator arm and the shaft are formed of plastic and the cam is formed of metal.

It is contemplated that the plastic is glass filled polypropylene, glass filled nylon, or a blend of glass filled polypropylene and nylon.

It is further contemplated that the metal is zinc.

DETAILED DESCRIPTION OF THE INVENTION

Figure 1:
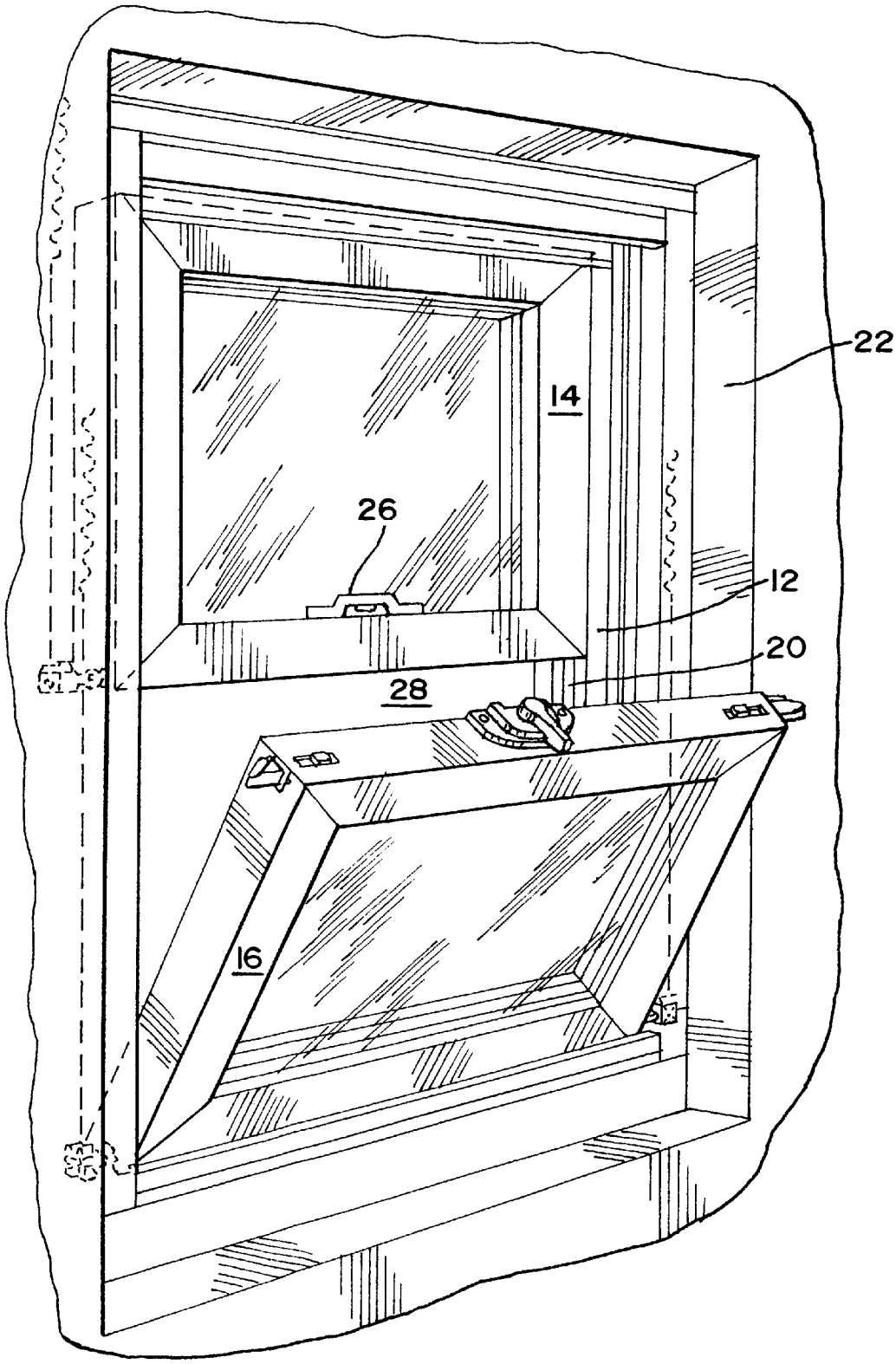
FIG. 1 is a perspective view of a sash window assembly.
Figure 2A:
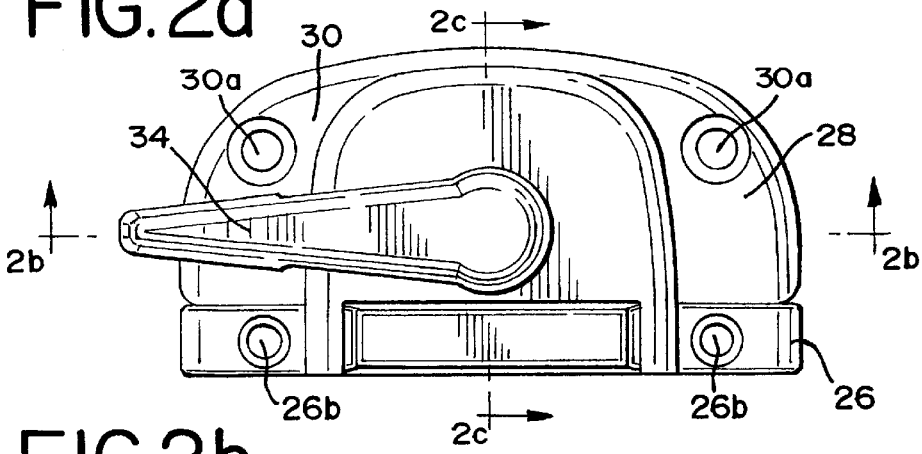
FIGS. 2*a,* 2*b,* and 2*c* are a top view of the sash lock of the present invention, and respective sectional views, thereof.
Figure 2B:
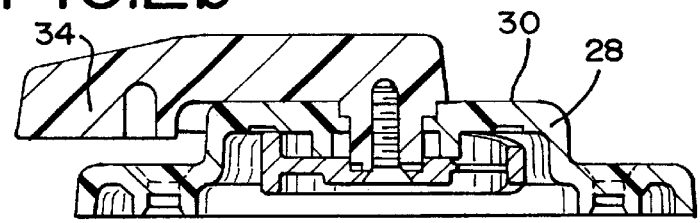
Figure 2C:
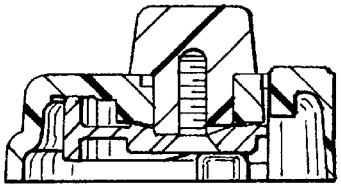
Figure 3A:
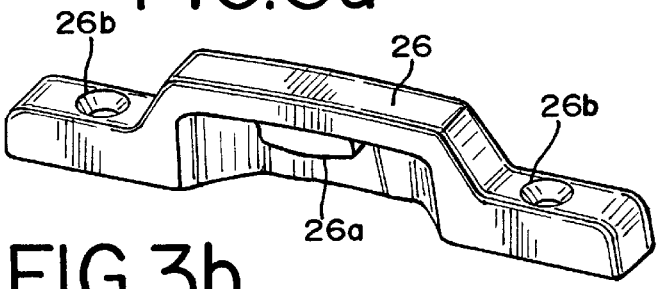
FIGS. 3*a,* 3*b,* 3*c,* and 3*d* are a perspective view, and top, side and bottom views, of a keeper of the sash lock of FIG. 1.
Figure 3B:
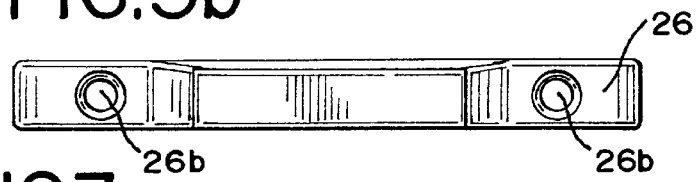
Figure 3C:
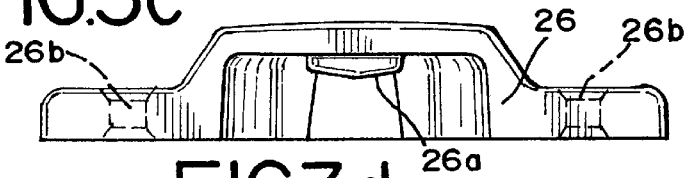
Figure 3D:
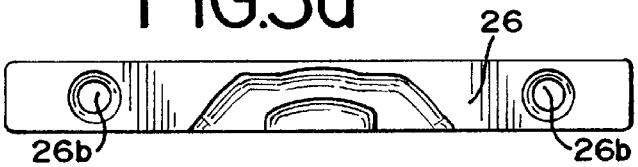
Figure 4A:
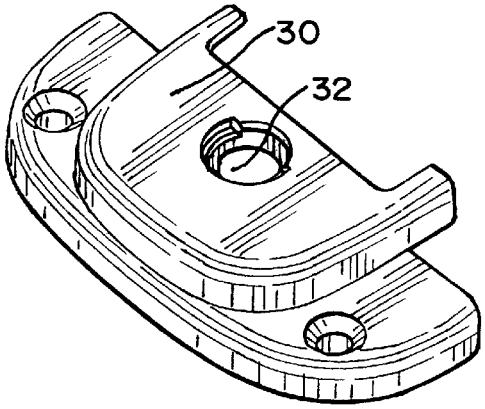
FIGS. 4*a,* 4*b* and 4*c* are respective perspective views and sectional view of a housing of the sash lock of FIG. 1.
Figure 4B:
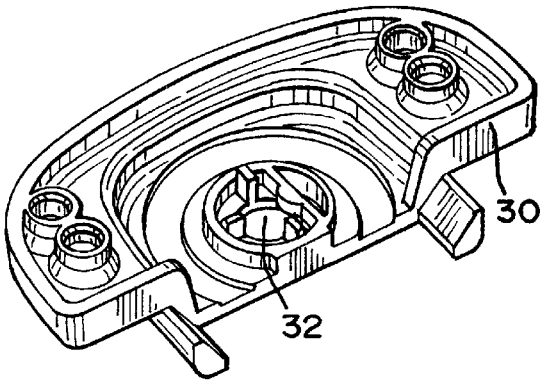
FIG. 4*d* is a detail of FIG. 4*c;*
FIG. 4*c* is a detail of a hole in the housing of FIGS. 4*a* and *b;*
Figure 4C:
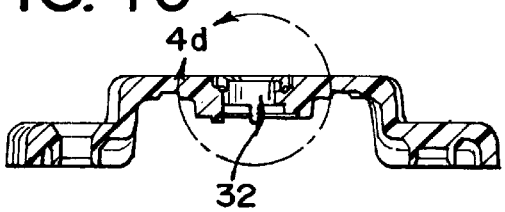
Figure 4D:
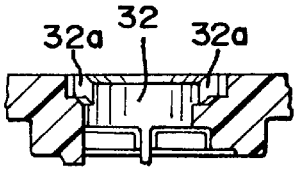
Figure 5A:
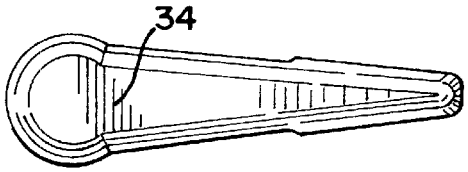
FIGS. 5*a,* 5*b,* and 5*c* are respective top, side and bottom views of an actuator arm of the sash lock of FIG. 1.
Figure 5B:
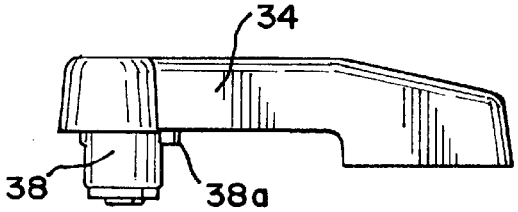
Figure 5C:
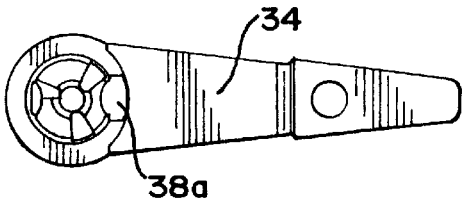
Figure 6A:
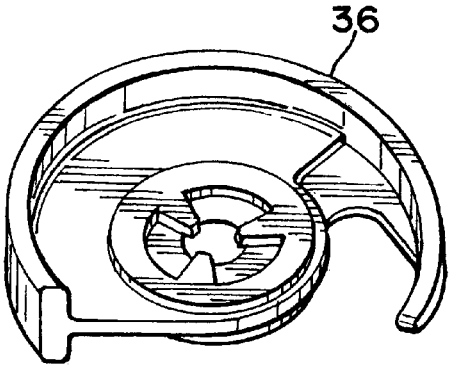
FIGS. 6*a,* 6*b,* 6*c* and 6*d* are respective perspective, top, bottom and sectional views of a cam of the sash lock of FIG. 1.
Figure 6B:
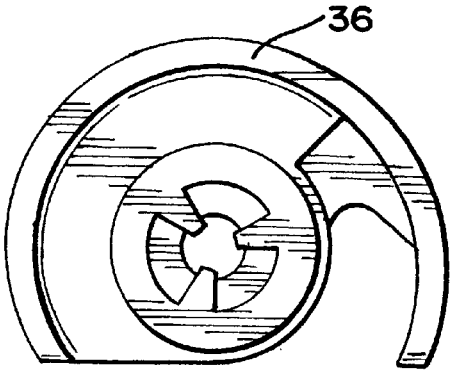
Figure 6C:
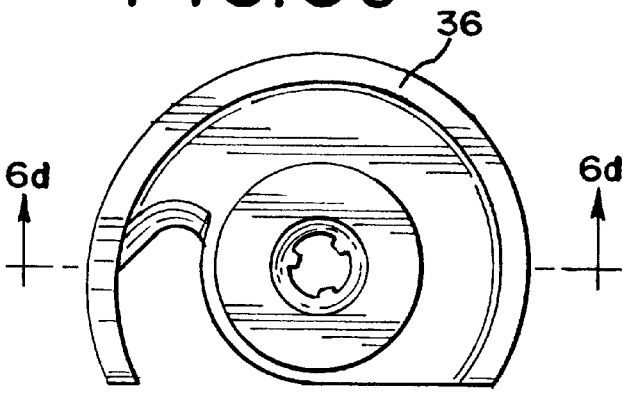
Figure 6D:
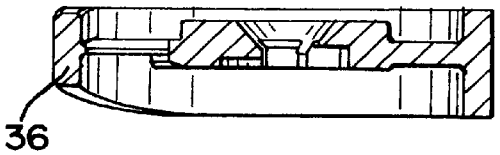

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A sash lock 10 for a sash window assembly 12 is illustrated in the Figures. Referring in particular to FIG. 1, the sash window assembly 12 includes an upper sash window 14 and a lower sash window 16. Each of the sash windows 14, 16 is mounted within opposed guide rails 20 on a master frame 22. At least one of the sash windows 14, 16 is slidable within the frame 22 relative to the other of the sash windows 14, 16.

Referring now to FIGS. 2–6, the sash lock 10 comprises a keeper 26 for mounting on a style of one of the upper sash windows 14. The keeper 26 includes a keeper surface 26*a*. The sash lock 10 also includes a locking assembly 28 for mounting on an adjacent style of the lower sash window 16. The locking assembly 28 includes a housing 30 having a hole 32, an actuator arm 34, and a cam 36 having a cam surface 36*a* for engaging the keeper surface 26*a*. The locking assembly 28 also includes a shaft 38 extending through the housing hole 32 and operably coupling the actuator arm 34 to the cam 36.

The keeper 26, the housing 30, the actuator arm 34 and the shaft 38 are formed of plastic. The plastic is preferably glass filled polypropylene, glass filled nylon, or a blend of glass filled polypropylene and nylon. The cam 36 is formed of metal, preferably zinc.

The actuator arm 34 and the shaft 38 are a unitary piece. The shaft 38 and the cam 36 have cooperatively mating faces for rotatably securing the shaft 38 to the cam 36. The shaft 38 and the hole 32 have corresponding circumferential surfaces. The shaft has a shaft projection 38*a* extending from its circumferential surface. The hole 32 has two spaced hole projections 32*a* extending from its circumferential surface. The shaft projection 38*a* engages one or the other of the hole projections 32*a* to limit rotational travel of the actuator arm 34 and thereby define unlocked and locked positions, respectively.

A shaft has a threaded screw receiving hole 38*b* to receive a metal screw (not shown) to secure the cam 36 to the shaft 38.

The housing 30 has a pair of holes for receiving screws (not shown) to secure the housing 30 to its style. The keeper 26 has a pair of keeper holes 26*a* for receiving screws (not shown) to secure the keeper 26 to its style.

While the specific embodiments have been illustrated and described, numerous modifications come to mind without significantly departing from the spirit of the invention and the scope of protection is only limited by the scope of the accompanying Claims.

We claim:

1. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock comprising:

a keeper for mounting on a style of one of the sash windows, the keeper including a keeper surface; and a locking assembly for mounting on an adjacent style of the other of the sash windows, the locking assembly including:

a housing having a hole;

an actuator arm;

a cam having a cam surface for engaging the keeper surface; and a shaft extending through the housing hole and operably coupling the actuator arm to the cam, wherein the keeper, the housing, the actuator arm and the shaft are formed of plastic and the cam is formed of metal;

the shaft and the hole have corresponding circumferential surfaces;

the shaft has a shaft projection extending from its circumferential surface; and the hole has spaced hole projections extending from its circumferential surface, and the shaft projection engages one or the other of the hole projections to define an unlocked or locked position, respectively.

2. The sash lock of claim 1, wherein the plastic is glass filled polypropylene.

3. The sash lock of claim 1, wherein the plastic is glass filled blend of polypropylene and nylon.

4. The sash lock of claim 1, wherein the plastic is glass filled nylon.

5. The sash lock of claim 1, wherein the metal is zinc.

6. The sash lock of claim 1, wherein the actuator arm and the shaft are a unitary piece.

7. The sash lock of claim 1, wherein each of the shaft and the cam have cooperatively mating faces for securing the shaft to the cam.

8. The sash lock of claim 1 including a metal screw for securing the cam to the shaft.

9. The sash lock of claim 1, wherein the housing has a pair of holes for receiving screws to secure the housing to its style.

10. The sash lock of claim 1, wherein the keeper has a pair of holes for receiving screws to secure the keeper to its style.

11. A sash lock for a sash window assembly, the sash window assembly including an upper sash window and a lower sash window, each of the sash windows mounted within opposed guide rails on a master frame, wherein at least one of the sash windows is slidable within the frame relative to the other sash window, the sash lock comprising:

a keeper for mounting on a style of one of the sash windows, the keeper including a keeper surface; and a locking assembly for mounting on an adjacent style of the other of the sash windows, the locking assembly including:

a housing having a hole;

an actuator arm having a shaft;

a cam having a cam surface for engaging the keeper surface; and a shaft extending through the housing hole and operably coupled to the cam, the shaft and the housing arranged to cooperatively limit rotational travel of the arm with respect to the housing;

the shaft and the hole have corresponding circumferential surfaces;

the shaft has a shaft projection extending from its circumferential surface; and the hole has two spaced hole projections on its circumferential surface, wherein the shaft projection engages one of the hole projections to define an unlocked position and engages the other hole projection to define a locked position.

12. The sash lock of claim 11, wherein the keeper, the housing, the actuator arm and the shaft are formed of plastic and the cam is formed of metal.

* * * * *

UNITED STATES PATENT AND TRADEMARK OFFICE

CERTIFICATE OF CORRECTION

PATENT NO. : 6,568,723 B1 
DATED : May 27, 2003
INVENTOR(S) : Mark V. Murphy and Dean Pettit It is certified that error appears in the above-identified patent and that said Letters Patent is hereby corrected as shown below:

Title page,
Item [73], correct the spelling of the name of the Assignee to:
-- Ashland Products, Inc. --

Signed and Sealed this

Twenty-sixth Day of August, 2003

JAMES E. ROGAN
*Director of the United States Patent and Trademark Office*